United States Patent [19]

Honsa et al.

[11] Patent Number: 5,027,910

[45] Date of Patent: Jul. 2, 1991

[54] VIBRATION-ISOLATED ROTARY TOOL

[75] Inventors: Thomas S. Honsa; Thomas W. Honsa, both of Moline, Ill.

[73] Assignee: Honsa Ergonomic Technologies, Inc., Rock Island, Ill.

[21] Appl. No.: 518,003

[22] Filed: May 2, 1990

[51] Int. Cl.[5] ..... B25D 17/11

[52] U.S. Cl. ..... 173/162.2; 173/168; 173/162.1

[58] Field of Search ..... 173/162.1, 169, 162.2, 173/168, 170

[56] References Cited

U.S. PATENT DOCUMENTS

| | | | |
|---|---|---|---|
| 3,934,657 | 1/1976 | Danielson | 173/169 |
| 4,327,807 | 5/1982 | Emonet | 173/162.1 |
| 4,648,468 | 3/1987 | Honsa | 173/162.2 |
| 4,905,772 | 3/1990 | Honsa et al. | 173/162.1 |

*Primary Examiner*—Timothy V. Eley
*Assistant Examiner*—Willmon Fridie, Jr.
*Attorney, Agent, or Firm*—Henderson & Sturm

[57] ABSTRACT

A rotary hand-held powered tool such as a grinder has an outer casing of rigid material and formed with a cavity in which is disposed a motor housing isolated from the casing by elastomer shock-absorbing material of the type that is pourable into the bell-shaped space between the motor housing and interior of the casing and which subsequently cures to become bonded to the interior surface of the casing and to the outer surface of the motor housing. The elastomer material is introduced to the bell-shaped space in laminar form; that is, in a series of stacked layers which vary as to Shore A hardness. The casing has a pair of handles rigidly attached thereto and configured to extend upwardly and forwardly with respect to the position of a user standing behind the casing.

14 Claims, 3 Drawing Sheets

Fig. 4
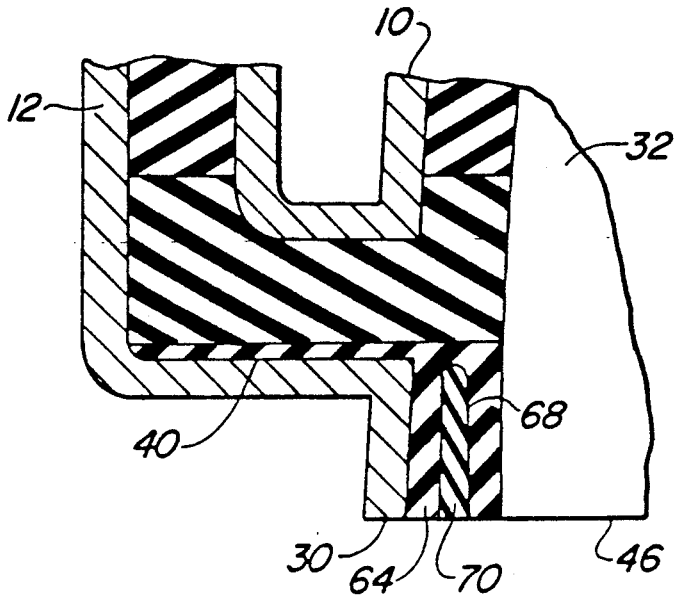
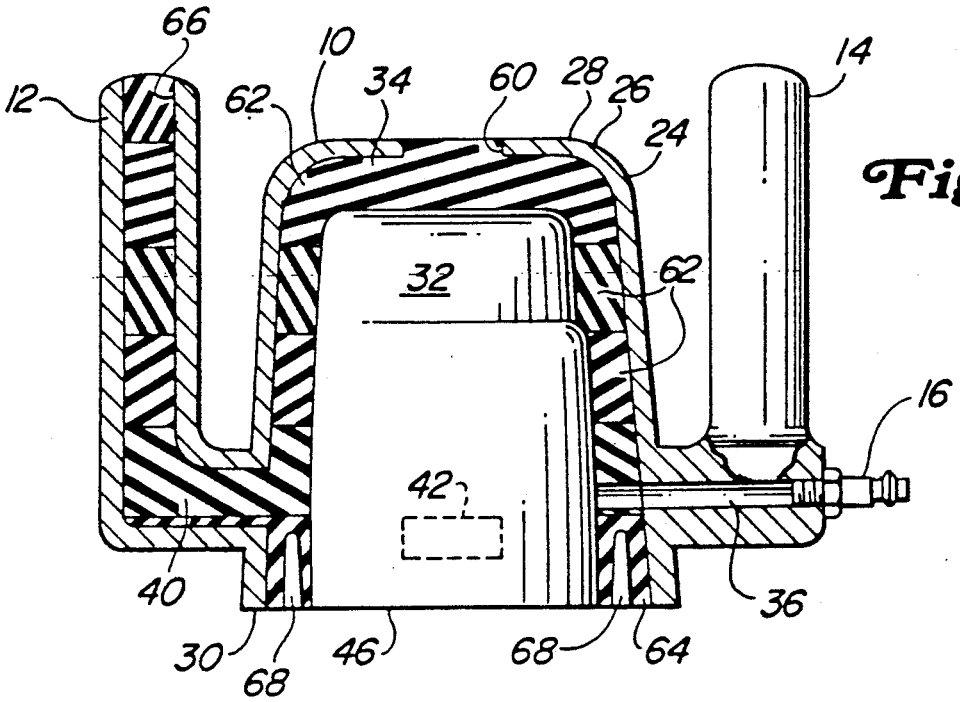
Fig. 3

VIBRATION-ISOLATED ROTARY TOOL

BACKGROUND AND SUMMARY OF THE INVENTION

It is known of course to provide vibration damping in hand-held tools and thereby to improve the use of the tool from the standpoint of increased operator comfort by minimizing the adverse effects of fatigue, carpal tunnel syndrome and the like. Prior examples of patented tools of the general type with which the present invention is concerned are the U.S. Patents to Honsa U.S. Pat. Nos. 4,648,468 and 4,771,833 and Honsa et al., U.S. Pat. No. 4,905,772. In the '772 design, an air motor is contained within a housing and isolated from relative vibration by an elastomer sleeve of molded form telescoped over the motor and disposed between the exterior of the motor and the interior surface of the housing. The sleeve is a separate element slipped onto the motor during assembly. The sleeve fits the motor rather tightly and is interlocked with the housing by elastomer key means. Further, handles attached to the housing are outwardly divergent from the housing and lie in a plane normal to the axis of rotation of the motor shaft, requiring that the user grip the handles with his wrists bent downwardly, a position found to be conducive to the creation of carpal tunnel syndrome, the characteristics of which are that the tendons passing through the narrow channel in the wrist are overused and press on the median nerve that controls feeling in the hand. The disorder is extremely painful and can be permanent.

According to the present invention, the foregoing and other disadvantages of prior structures are eliminated by an improved design in which a motor housing is contained within a dome-like casing and isolated from the casing by poured-in elastomer vibration and torque isolating material that fills the bell-shaped space between the interior surface of the casing and the outer surface of the motor housing. Further, the elastomer is introduced in laminar form, or layer by layer, each layer being allowed to at least partially set up before the introduction of subsequent layers. A further feature is that not all layers are of the same Shore A hardness, which further adds to the efficacy of the isolation. It is significant that the handles attached to the outer casing extend upwardly and forwardly with respect to a user standing behind the tool, enabling the user to grasp the handles with his wrists fairly straight, with his fingers wrapped about the grips and with his thumbs uppermost, positions determined to be instrumental in eliminating or materially reducing fatigue and the effects of carpal tunnel syndrome.

Features in addition to the foregoing will become apparent as a preferred embodiment of the invention is disclosed in the ensuing description and accompanying drawings.

DESCRIPTION OF THE DRAWINGS

FIG. 3 is a reduced-scale vertical section of the structure shown in FIG. 1.

FIG. 4 is an enlarged fragmentary section of a modified form of the invention.

DETAILED DESCRIPTION OF A PREFERRED EMBODIMENT OF THE INVENTION

Figure 1:
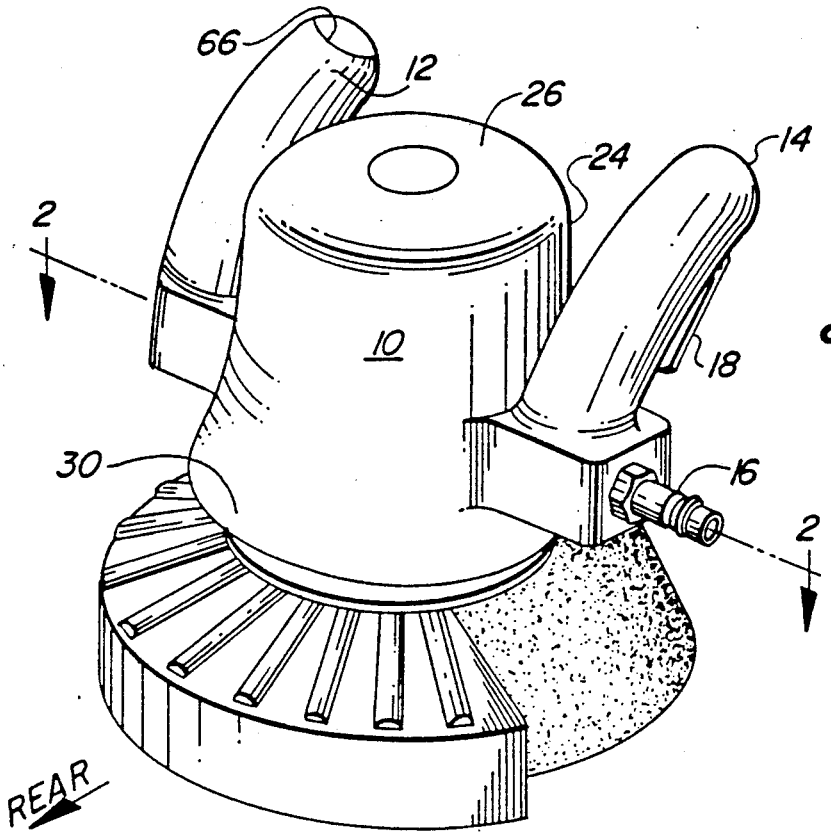
FIG. 1 is a perspective illustrating one form of tool in which the invention finds especial utility.

Reference will be had first to FIG. 1 for an over-view of the basic representative structure. In that Figure, the numeral 10 designates an external casing of dome-like configuration, constructed of rigid material, such as aluminum; although, other materials, metal or non-metal, may be used. Rigidly attached to diametrically opposite sides of the casing are handle means including left and right handle grips 12 and 14, respectively, also of rigid material. The handles are similar except for differences to be pointed out later herein and each is configured to extend generally in parallelism and upwardly and forwardly as respects the position of a user standing behind the tool. An arrow designed "REAR" indicates the rearward direction relative to the tool in use. Further, each grip has a slightly curved shape about a rather large radius so as to contribute further to the comfort of the user in handling the tool during use thereof. In the present illustration, the tool is air-driven and a fitting for an air hose or the like (not shown) is indicated at 16. A control trigger 18 is shown on the right-hand grip 14 for controlling valving (not shown) which may be of any suitable type and contained within the grip 14. The invention is applicable as well to electric, hydraulic and other powered tools, vertical or horizontal. The vertical axis tool disclosed here is exemplary and the words "top", "bottom", etc., are used as explanatory and not limiting. The details of the control are not important to the disclosure of the invention. The rear lower part of the tool carries a shroud 20 as a partial enclosure for a grinding wheel 22.

Figure 2:
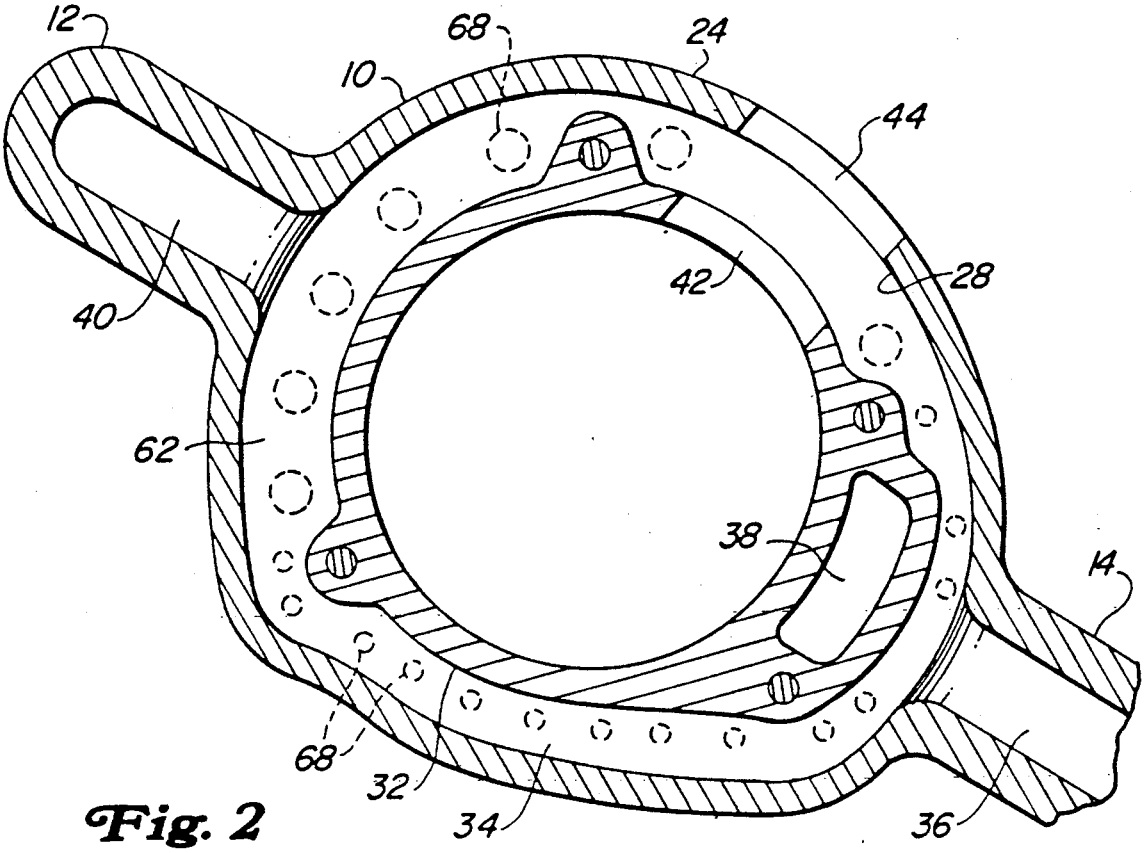
FIG. 2 is an enlarged section as seen generally along the line 2—2 of FIG. 1.

As best shown in FIG. 3, the casing 10 has an annular wall 24 and an integral top wall 26 which combine to give the casing a cavity 28. The casing has a generally circular bottom 32 at which the casing opens downwardly or outwardly. A motor housing or shell 32 of rigid material is disposed within the cavity 28 generally in central relation and is so configured and dimensioned relative to the cavity as to provide a bell-shaped space 34 between the inner surface of the casing and the outer surface of the motor housing; i.e., the space substantially envelops the motor housing except at the open bottoms of the assembled casing and housing. As seen in FIGS. 2 and 3, the right grip 14 has an air passage 36 leading to an air passage 38 (by means not shown) in the motor housing 32. See also FIG. 3. The left grip 12 is shown as being hollow and in communication at 40 with the bell-shaped space 34 for purposes to appear subsequently. Communicating air exhaust passages 42 and 44 exist respectively in the motor housing and casing wall 24. The motor housing 32 is further dimensioned so that it has a bottom 46 substantially coplanar with the casing bottom 30. Also as best seen in FIG. 5, the bottom of the motor housing has a plurality of tapped bores 48 for purposes to presently appear.

Figures 5, 6:
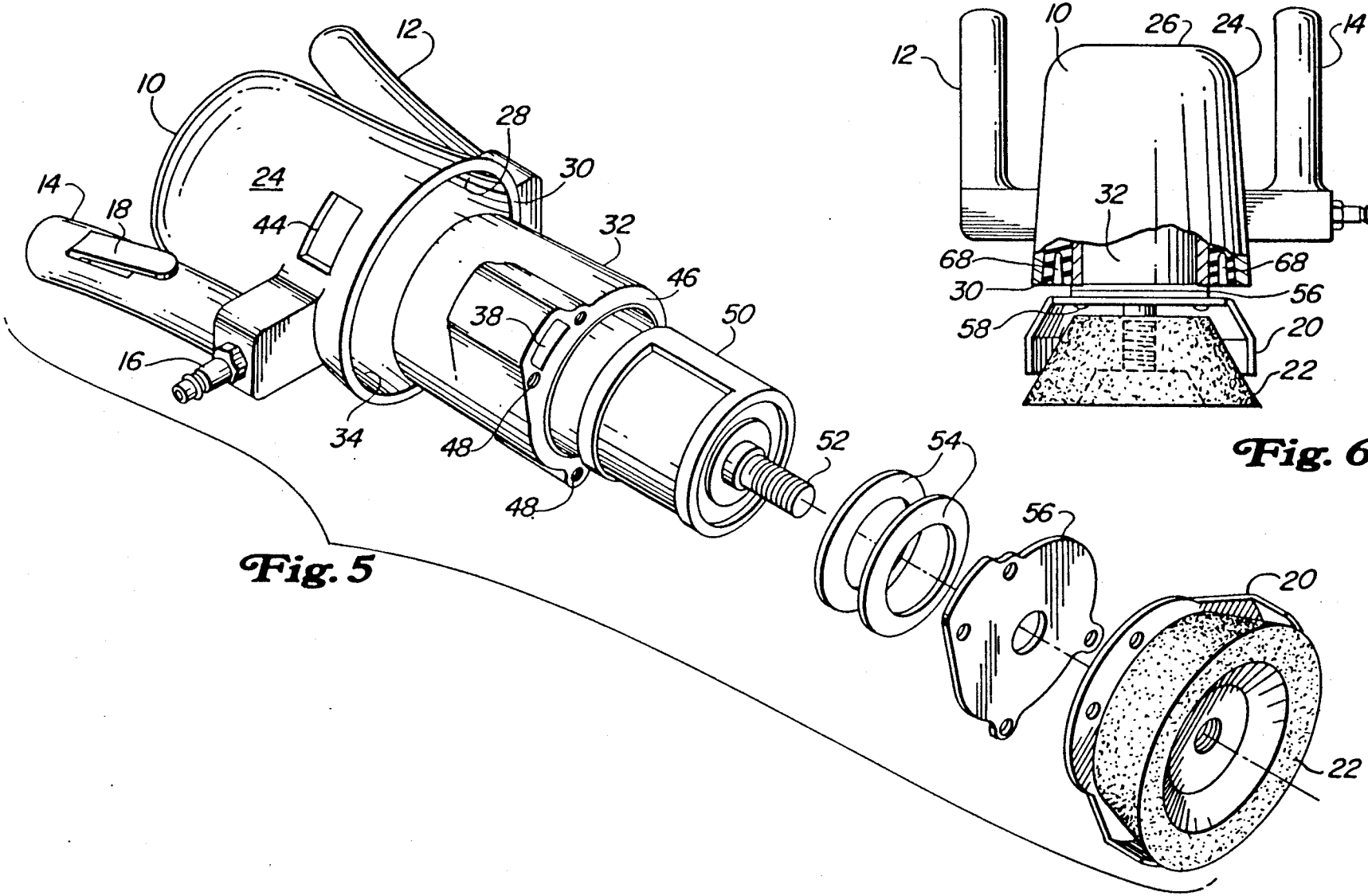
FIG. 5 is an exploded perspective showing the basic components.
FIG. 6 is a reduced-scale elevation, partly in section of the tool as finally assembled.

FIG. 5 shows in exploded fashion the basic components of the tool prior to assembly. It is seen in this figure that the motor housing is of smaller diameter than the cavity 28. The motor housing itself is cylindrical or nearly so and receives a motor 50, here of the typical pneumatic or air-driven type having a drive shaft 52 which mounts the grinding wheel 22. In the final assembly, washers 54 of the Belleville type overlie the outer end of the motor, followed by a plate 56 and then the shield or shroud 20. Cap screws 58 (FIG. 6) fit the tapped bores 48 in the motor housing 32 to complete the "mechanical" assembly.

Prior to final assembly, the casing and motor housing are arranged with the motor housing disposed within the cavity and centered so as to produce the bell-shaped space 34, it being observed from FIG. 3 that the height or altitude of the motor housing is less than the vertical depth of the cavity so that the bell-shaped space extends around and over the top of the motor housing. The casing and housing thus arranged may be placed in a suitable fixture and appropriate plugs, etc., temporarily used to block ports and passages so that when the elastomer vibration-isolating material is introduced, the passages are not filled with elastomer. It is preferred that the bottom of the cavity be closed and that the bottom of the motor housing be also closed, as by placing the casing and housing on a flat plate or the like. The top wall 26 of the casing has an opening 60 therein through the elastomer material is introduced. The port, when filled, also serves as a release or escape for excess vibration. The elastomer may be of any suitable pourable type and is applied to the bell-shaped space in stacked layers 62. In the present case, there are five layers, the lowermost of which constitutes a ring 64 at the bottoms of the casing and motor housing. The introduction of the layers is such that the first layer (ring 64) is introduced and allowed to at least partially set and thereby bind itself to the proximate surfaces of the casing and motor housing. The second layer is similarly poured, allowed to set and the third layer poured and so on. The elastomer of the layers is different from layer to layer, the first, third and fifth layers having a Shore A hardness greater than that of the second and fourth layers. For example the Shore A of the first layer may be in the range of forty to fifty and that of the softer layers in the range of twenty to thirty. Since the grip 12 is hollow, it may likewise be filled with elastomer, preferably also in layers as just described, being introduced through an opening 66 in the top of the grip. In the end, part of the top layer in the grip will close the opening 66 just as a top portion of the top layer in the casing fills the top wall opening 60, the top layer projecting into the opening on the order of the thickness of the wall 26. The layers, of course, bond to each other as well as to the housing and casing. the material is a polyurethane pourable of temperatures in the range of 68° to 100° F., setting up in approximately one minute.

FIG. 2 is a section in which the plane of the section passes through the juncture of the two adjacent layers and thus the elastomer at 62 is not shown in section and further, because to do so, would confuse the figure. In that view, the plugs, etc., used during the pouring process have been removed so that the air and exhaust passages, etc., are unobstructed. Since the relationship of these passages to the motor 50 may be of any known type, the details have been omitted.

Within the lower part of the bell-shaped space 28 are a plurality of dotted circles representing short upright voids 68, appearing in full lines in FIGS. 3 and 6. These may be formed in any suitable manner, as by appropriate means (not shown) used during the pouring of the layers or subsequently by drilling, etc. These voids further improve the effects of the elastomer in damping vibration, by way of diffusion, attenuation, etc. In a modified design, the voids may be filled with elastomer 70 (FIG. 4), preferably of a Shore A hardness greater than that of the ring 64.

It will be seen from the foregoing that an improved tool has been provided in which adverse effects of vibration, whether axial or torque-wise or both, have been substantially eliminated or at least reduced to relatively minor levels, thus enabling the user to work fairly free from fatigue and other trauma leading to carpal tunnel syndrome and the like, a problem of such magnitude that in some instances resort has been had to special gloves for the workmen, alternating job functions and other methods found to be mainly stop-gap at best. The present design is simple and the elastomer-connected (by bonding) parts will have a prolonged useful life. The mechanical parts that may require repair, replacement, etc., can be easily disassembled for those purposes.

Features and advantages other than those pointed out will be readily apparent to those versed in the art, as will many modifications in the preferred embodiment disclosed, all without departure from the spirit and scope of the invention.

We claim:

1. A portable hand-held power tool comprising a dome-like casing of rigid material and having a top and a bottom and including integrally related top and annular walls providing a substantially cylindrical cavity that opens downwardly at said bottom, handle means attached to and extending from the casing, a motor housing of rigid material disposed generally coaxially within the casing and so configured and dimensioned relative to the cavity as to leave a bell-shaped space between the interior surface of the cavity and the exterior surface of the motor housing, said housing having an open bottom adjacent to the open bottom of the casing, a motor within the housing and having a tool-driving part projecting at the open bottom of the housing and casing, means securing the motor to the bottom of the housing, elastomer vibration-isolating material within the bell-shaped space and bonded to the interior surface of the cavity and the exterior of the motor housing, the elastomer material forming a ring concentrically about the lower part of the motor housing and within the cavity, and said ring having a plurality of voids spaced apart angularly about the lower part of the motor housing and opening downwardly at the bottom of the casing.

2. The tool according to claim 1, in which at least some of the voids are filled with elastomer vibration-isolating material other than that filling the bell-shaped space.

3. The tool according to claim 2, in which the Shore A hardness of the void-filling material is greater than that of the other material in the ring.

4. The tool according to claim 1, in which the elastomer material is of a pourable type introduced into and cured within the bell-shaped space as a plurality of stacked layers in which each layer is bonded to its neighbor.

5. The tool according to claim 4, in which at least two of the layers are of different Shore A hardness.

6. The tool according to claim 5, in which alternate layer are of different Shore A hardness.

7. The tool according to claim 6, in which there are at least three layers and the first and third layers have a Shore A hardness greater than the second layer.

8. The tool according to claim 1, in which the top wall of the casing has an opening therein into which an upper portion of the elastomer material projects by a distance on the order of the thickness of said top wall.

9. A portable hand-held power tool comprising a dome-like casing of rigid material and having a top and a bottom and including integrally related top and annular walls providing a substantially cylindrical cavity that opens downwardly at said bottom, handle means attached to and extending from the casing, a motor housing of rigid material disposed generally coaxially within the casing and so configured and dimensioned relative to the cavity as to leave a bell-shaped space between the interior surface of the cavity and the exterior surface of the motor housing, said housing having an open bottom adjacent to the open bottom of the casing, a motor within the housing and having a tool-driving part projecting at the open bottom of the housing and casing, means securing the motor to the bottom of the housing, elastomer vibration-isolating material within the bell-shaped space and bonded to the interior surface of the cavity and the exterior of the motor housing, the elastomer material forming a ring concentrically about the lower part of the motor housing and within the cavity, and said ring having a plurality of voids spaced apart angularly about the lower part of the motor housing and opening downwardly at the bottom of the casing and handle means comprising a pair of generally upright handle grips rigid with and projecting upwardly at diametrically opposite sides of the casing.

10. The tool according to claim 9, in which each hand grip has a lower portion joined to the casing adjacent to the bottom of the casing and an upper terminal end adjacent to the top of the casing, and the lower portion of one hand grip has a passage therethrough opening interiorly of the casing to the motor and opening horizontally exteriorly for connection to a power source.

11. The tool according to claim 9, in which the hand grips are configured to extend upwardly and forwardly with respect to a user person standing behind the tool.

12. The tool according to claim 11, in which the configuration of each hand grip includes a forward curve on a relative large radius so as to comfortably fit the closed hand of a user grasping the grip.

13. The tool according to claim 12, in which at least one of the hand grips has a hollow interior and is filled with elastomer shock-absorbing material.

14. The tool according to claim 13, in which the hollow interior communicates through the casing annular wall with the bell-shaped space and the elastomer material in said handle is an integrated part of the elastomer material in said bell-shaped space.

* * * * *